US006384798B1

(12) United States Patent
Barta et al.

(10) Patent No.: US 6,384,798 B1
(45) Date of Patent: May 7, 2002

(54) QUADRIFILAR ANTENNA

(75) Inventors: Gary S. Barta, Duarta; Scott A. Caslow, La Habra, both of CA (US)

(73) Assignee: Magellan Corporation, San Dimas, CA (US)

( * ) Notice: Subject to any disclaimer, the term of this patent is extended or adjusted under 35 U.S.C. 154(b) by 0 days.

(21) Appl. No.: 08/937,072

(22) Filed: Sep. 24, 1997

(51) Int. Cl.[7] ..... H01Q 1/36; H01Q 1/38; H01Q 11/08

(52) U.S. Cl. ..... 343/895

(58) Field of Search ..... 343/895; H01Q 1/36, H01Q 1/38, 11/08

(56) References Cited

U.S. PATENT DOCUMENTS 5,198,831 A * 3/1993 Burrell et al. ..... 343/895
5,541,617 A * 7/1996 Connolly et al. ..... 343/895
5,635,945 A * 6/1997 McConnell et al. ..... 343/895
5,990,847 A * 11/1999 Filipovic et al. ..... 343/895

* cited by examiner

*Primary Examiner*—Michael C. Wimer
(74) *Attorney, Agent, or Firm*—Philip T. Virga

(57) ABSTRACT

A quadrifilar antenna for use in satellite communications comprises four conductive elements arranged to define two separate helical pairs, one slightly differing in electrical length than the other, defined by a cylinder of constant radius supported by itself or by a cylindrical non-conductive substrate. The two separate helical pairs are connected to each other in such a way as to constitute the impedance matching, electrical phasing, coupling and power distribution for the antenna. In place of a conventional balun, the antenna is fed at a tap point on one of the conductive elements determined by an impedance matching network which connects the antenna to a transmission line. The matching network can be built with distributed or lumped electrical elements and can be incorporated into the design of the antenna.

8 Claims, 6 Drawing Sheets

QUADRIFILAR ANTENNA

BACKGROUND OF THE INVENTION

This invention generally relates to quadrifilar antennas used for radiating or receiving circularly polarized waves. More particularly, this invention relates to an improved quadrifilar antenna and its feed system for coupling signals of equal magnitude and 90 degrees out of phase to one end of the antenna, and to a method of manufacturing such an antenna.

It is well known that helical antennas comprising a plurality of resonant elements arranged around a common axis are particularly useful in ground links with orbiting satellites or in mobile/relay ground links with geosynchronous satellites. Due to the arrangement of the helical elements, the antenna exhibits a dome-shaped spatial response pattern and polarization for receiving signals from satellites. This type of antenna is disclosed in "Multielement, Fractional Turn Helices" by C. C. Kilgus in IEEE Transactions on Antennas Propagation, July 1968, pages 499 and 500. This paper teaches, in particular, that a quadrifilar helix antenna can exhibit a cardioid characteristic in an axial plane and be sensitive to circularly polarized emissions.

One type of prior art helical antenna comprises two bifilar helices arranged in phase quadrature and coupled to an axially located coaxial feeder via a split tube balun for impedance matching. While antennas based on this prior design are widely used because of the particular response pattern, they have the disadvantage that they are extremely difficult to adjust in order to achieve phase quadrature and impedance matching, due to their sensitivity to small variations in element length and other variables, and that the split tube balun is difficult to construct. As a result, their manufacture is a very skilled and expensive process.

Therefore, there is a need for a quadrifilar antenna having a predetermined input impedance which could be manufactured on a production basis without the need for adjustment and costly individual tuning. Further, there is a need to provide a quadrifilar antenna having a simplified feed arrangement that avoids the complexities of conventional folded, stepped or split shield baluns.

The subject invention herein solves all of these problems in a new and unique manner which has not been part of the art previously. Some related patents are described below:

U.S. Pat. No. 5,635,945 issued to McConnell et al on Jun. 2, 1993

This patent is directed to a quadrifilar helix antenna comprising four conductive elements arranged to define two separate helically twisted loops, one slightly differing in electrical length than the other, to define a cylinder of constant radius supported by itself or by a cylindrical nonconductive substrate. The two separate helically twisted loops are connected to each other in such a way as to constitute the impedance matching, electrical phasing, coupling and power distribution for the antenna.

U.S. Pat. No. 5,191,352 issued to S. Branson on Mar. 2, 1993

This patent is directed to a quadrifilar antenna comprising four helical wire elements shaped and arranged so as to define a cylindrical envelope. The helical wires are mounted at their opposite ends by first and second printed circuit boards having coupling elements in the form of plated conductors which connect the helical wires to a feeder or semi-rigid coaxial cable on the first board, and with each other on the second board. The conductor tracks are such that the effective length of one pair of helical wires and associated impedance elements is greater than that of the other pair of helical wires, so that phase quadrature is obtained between the two pairs.

U.S. Pat. No. 4,008,479 issued to V. C. Smith on Feb. 15, 1977

This patent is directed to a dual-frequency circularly polarized antenna. The antenna comprises a longitudinal cylindrical non-conductive member supported at its top by four conductors each extending transversely from a center coaxial line. Two sets of the antenna conductors are attached to the non-conducting cylinder in a configuration of equally longitudinally spaced spirals. The two sets of conductors are conductively connected by pins such that one set corresponds to a half wavelength at one frequency and the other set corresponds to a half wavelength at another frequency.

U.S. Pat. No. 3,623,113 issued to I. M. Falgen on Nov. 23, 1971

This patent is directed to a tunable helical monopole antenna. The tunable helical monopole antenna comprises a winding having both an upper portion and a lower portion which are symmetrically substantially identical to each other. Connected to each end of the winding halves are cylindrical terminal dipole elements and connected to these terminal elements are shorting fingers. By synchronously moving the shorting fingers, the respective helical windings are effectively shorten or lengthen for tuning purposes.

U.S. Pat. No. 5,255,005 issued to Terret et al. on Oct. 19, 1993

This patent is directed to a dual layer resonant quadrifilar helix antenna. The antenna comprises a quadrifilar helix formed by first and second bifilar helices positioned orthogonally and excited in phase quadrature. Additionally, a second quadrifilar helix is coaxially and electromagnetically coupled to a first quadrifilar helix.

U.S. Pat. No. 4,148,030 issued to P. Foldes on Apr. 3, 1979

This patent is directed to a combination helical antenna comprising a plurality of tuned helical antennas which are coaxially wound upon a hollow cylinder, whereby the antennas are collocated. The antenna further comprises a printed circuit assembly having thin metal dipoles of the type used in a microwave strip line. The thin metal dipoles are resonating elements that are coupled to each other in a manner similar to end-fire elements of a microstrip filter.

While the basic concepts presented in the aforementioned patents are desirable, the apparatus employed by each to produce a quadrifilar antenna are mechanically far too complicated to render them as an inexpensive means of achieving an antenna having a predetermined input impedance which could be manufactured on a production basis without the need for adjustment and costly individual tuning and still present desired radiation characteristics during operation.

SUMMARY OF THE INVENTION

A quadrifilar antenna for use in satellite communications comprises four conductive elements arranged to define two separate helical pairs with both pairs being open circuited at one end, one pair slightly differing in electrical length than the other, to define a cylinder of constant radius supported by itself or by a cylindrical non-conductive substrate. The two separate helical pairs are connected to each other in such a way as to constitute the impedance matching, electrical phasing, coupling and power distribution for the antenna. In place of a conventional balun, the antenna is fed at a tap point on one of the conductive elements determined by an impedance matching network which connects the antenna to a transmission line. The matching network can be built with distributed or lumped electrical elements and can be incorporated into the design of the antenna.

Therefore, it is an object of the present invention to provide a simple matching network where the inductance of the conductor leading to the tap point is tuned out by a capacitor connected to the transmission line used to transfer radio frequency signals to and from the antenna.

An object of the present invention is to provide a quadrifilar antenna formed by a pair of helical elements where the coupling between the pair of helical elements is provided by a shared common current path.

A further object of the present invention is to have a quadrifilar antenna which has a simple feed method that does not require the use of conventional folded, stepped or split shield baluns.

Another object of the present invention is to provide a quadrifilar antenna formed by printed circuit boards which can be relatively accurately formed with predetermined shapes and dimensions, such that relatively little, if any, adjustment is required to obtain an antenna having the required electrical characteristics.

Yet, still another object of the present invention is to have a quadrifilar antenna which can be mass-produced to precise dimensions with high reproducibility of electromagnetic characteristics.

Still, yet another object of the present invention is to provide a quadrifilar antenna which is especially simple in construction, particularly light weight and compact in design.

A further object of the present invention is to provide a low cost antenna having a quasi-hemispherical radiation pattern of the type formed by two bifilar helices used in ground and orbital satellite telecommunication links or in mobile relay telecommunication links with geosynchronous satellites.

Another object of the present invention is to provide a method of making a radio frequency antenna having a plurality of helical elements formed through the use of alignment tabs for ease and accuracy in manufacturing.

Accordingly, it is an object of the present invention to provide an effective, yet inexpensive and relatively mechanically unsophisticated quadrifilar antenna, which is rugged yet lightweight, easily carried and used.

BRIEF DESCRIPTION OF THE DRAWINGS

The above, as well as other, advantages of the present invention will become readily apparent to those skilled in the art from the following detailed descriptions of the preferred embodiment when considered in light of the accompanying drawings in which.

DESCRIPTION OF THE PREFERRED EMBODIMENTS

Figure 1:
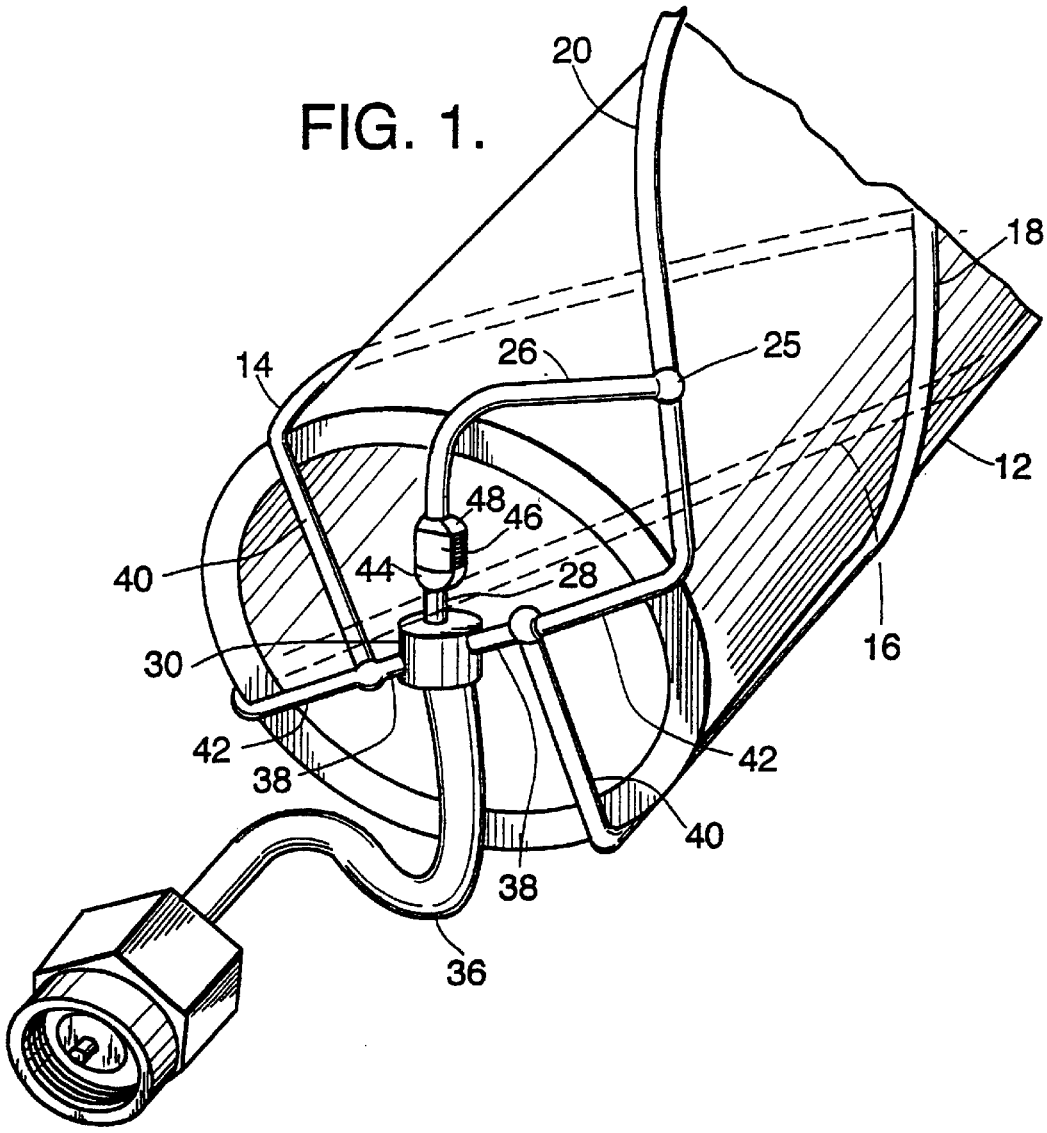
FIG. 1 is a perspective view of a quadrifilar helix antenna in accordance with the present invention.

Referring now to the drawings wherein like reference numerals refer to like and corresponding parts throughout, the quadrifilar antenna in accordance with the present invention is generally indicated by numeral 10. Referring to FIG. 1, the quadrifilar antenna 10 comprises a generally elongated non-conducting cylindrical support tube 12 having four conductive elements 14, 16, 18 and 20 supported on an outer surface of tube 12 so as to make the antenna 10 right-hand or left-hand circularly polarized. Although not shown, it should be envisioned that the elements 14, 16, 18 and 20 could be self-supporting without tube 12 by the use of rigid wire or could be arranged against the inner surface of tube 12.

Referring once again to FIG. 1, a first helical pair is formed by elements 14 and 18 and equal conductors 40 which are slightly longer than a second helical pair formed by elements 16 and 20 and equal conductors 42. As shown in FIG. 1, the first and second helical pairs are not connected at one end, thereby forming an electrical open circuit. In this configuration, the first and second helical pair have two different electrical lengths translating into two different resonant frequencies which are chosen by design to result in an electrically 90 degree phase difference between the currents induced in each helical pair thus maintaining phase quadrature. A common section 38 is shared at one end by each helical pair and provides the coupling from the driven helical pair formed by elements 16 and 20 and equal conductors 42 to the other helical pair formed by elements 14 and 18 and equal conductors 40.

Turning once again to FIG. 1, a coaxial transmission line 36 has its inner conductor 28 connected at one end 44 of a capacitor 46 whose other end 48 connects through a conductor 26 to a tap point 25 on element 20 to effectively impedance match antenna 10 without the use of a conventional balun. The placement and value of capacitor 46 and length and tap point of conductor 26 are predetermined from the desired input impedance presented by transmission line 36. Although transmission line 36 is shown as coaxial, it may be any variety of transmission lines used to carry radio frequency signals. Therefore, the capacitor 46 and conductor 26 are used to tune out the reactance and inductance of the antenna 10 at the antenna frequency. An outer conductor 30 of transmission line 36 connects to the midpoint of common conductor section 38. The shape of the antenna 10 may be cylindrically round or square or tapered without altering the intent of the invention.

It is understood by those familiar with the art that any method of feeding the antenna 10 with a variety of unbalanced transmission lines in addition to coaxial, such as microstrip or strip line can be accomplished by connecting the signal line to the capacitor 46 at capacitor end 44 and the ground or signal return side to the midpoint of shared common segment 38.

It is also understood by those skilled in the art, that a transmission line is a common and practical way of transferring radio frequency electrical signals between circuits and antennae and is used herein as an example of how the invention can be utilized. However, the invention described here is placed very near to nearby circuits or adjacent to printed circuit boards directly where the coupling of signals to the antenna can be accomplished without the need for a conventional transmission line.

Figure 2:
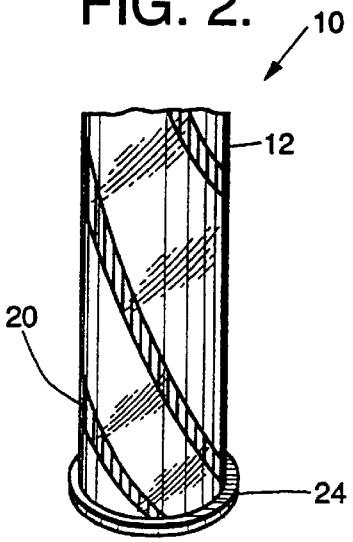
FIG. 2 is a perspective view of one preferred embodiment of the quadrifilar helix antenna in accordance with the present invention.
Figure 3:
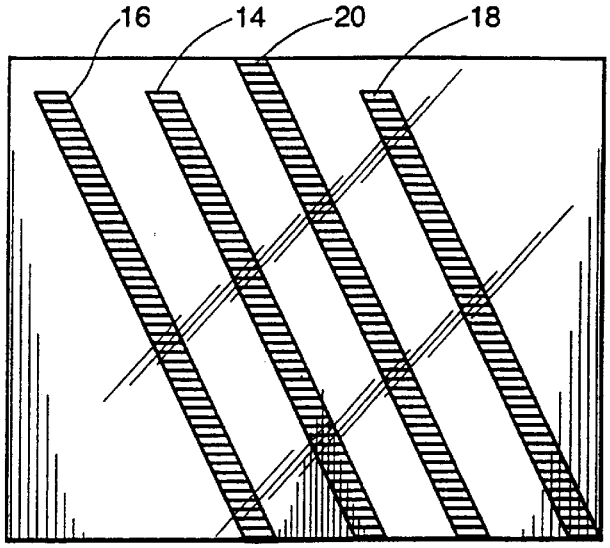
FIG. 3 is a plan view of the conductive elements shown in FIG. 2.

Referring now to the drawings, and more particularly to FIGS. 2 and 3, another preferred embodiment of the quadrifilar antenna 10 comprises a generally elongated longitudinal cylindrical substrate 12 having the four conductive elements 14, 16, 18 and 20 supported on its outer surface with the four conductive elements 14, 16, 18 and 20 not connected at one end and having mounted a printed circuit board 24 at the other end. As shown in FIG. 2, the conductive elements 14, 16, 18 and 20 respectively, are arranged as helical elements around the outer surface of the substrate 12 so as to make the antenna 10 right-hand circularly polarized. Although not shown, it should be envisioned that the antenna 10 could similarly be left-hand circularly polarized.

In the preferred embodiment, the cylindrical substrate 12 is made from a non-conductive material such as glass, fiberglass or the like, having a dielectric constant that corresponds to the width, length and material of the conductive elements 14, 16, 18 and 20 wherein each helical pair is preferably in a range of a quarter wavelength of the desired resonant frequencies. Using higher dielectric materials can result in significant shortening of the physical antenna structure. The cylindrical structure 12 can be formed as a tube or a flat structure rolled into a tubular shape and may have a cross section which is either circular or square as will be more fully described below. However, it should be well understood that the substrate or material can be varied without deviating from the teachings of the subject invention. The conductive elements 14, 16, 18 and 20, respectively, may be made from copper, silver or like metals and are metal plated onto the substrate 12 by any type of coating technique known in the metallic plating arts.

Turning now to FIG. 3, the conductive elements 14, 16, 18 and 20, respectively, are shown in a plane in order to further distinguish certain characteristics unique to the subject invention. As shown in FIGS. 2 and 3, the conductive elements 14, 16, 18 and 20, respectively, are parallel and substantially equally transversely spaced from each other when plated onto the substrate 12. As shown in FIG. 3, conductive element 18 is slightly longer then conductive elements 14, 16 and 20 wherein the length of conductive element 18 is predetermined from the desired input impedance and results in the antenna 10 being manufactured on a production basis without the need for adjustment and costly individual tuning as will be more fully described below.

Figure 4:
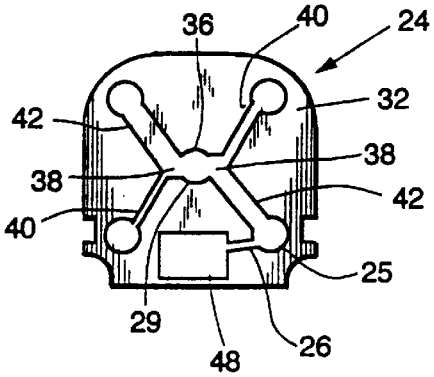
FIG. 4 is a top plan view of one side of a first printed circuit board of the antenna of the present invention.
Figure 5:
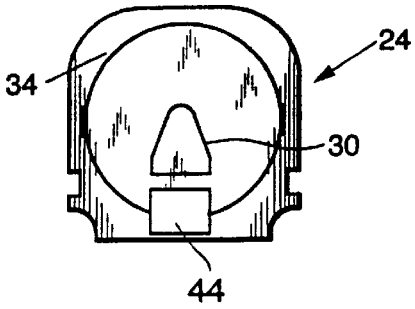
FIG. 5 is a top plan view of a second side of the printed circuit board shown in FIG. 4.

Referring now to FIGS. 4 and 5, there is shown a first side 32 and second side 34 of the printed circuit board 24, which is used to perform both the power distribution and impedance matching for the antenna 10. The printed circuit board 24 comprises microstrip portion 29 over a ground conductor 30 shown in FIG. 5 on the second side of the board 24, wherein the microstrip structure of 29 and 30, respectively, are electrically coupled and connected to each other to form a ground return path 36.

Turning now to FIG. 4, the transmission line 36 of the board 24 terminates into the midsection of generally rectangular portions 38, the common section coupling the helical pairs, centered on the board 24. The rectangular portions 38 have a first set 40 and a second set 42 of connecting lines, each set of connecting lines 40 and 42, being electrically connected to a respective one of the conducting elements 14, 16, 18 and 20, serving the same purpose as described in FIG. 1. For electrical characteristic purposes, such as frequency bandwidth, the first set 40 of the connecting lines have a different electrical length, translating into two different resonant frequencies, than the second set 42 of connecting lines, and is a matter of design choice. Even though in the preferred embodiment, the connecting lines are shown as straight, it may be envisioned that the connecting lines may also meander to obtain longer electrical lengths.

Referring once again to FIG. 4, on the first side 32 of the board 24 is formed a first capacitive element 48 separated from the rectangular portions 38 and is connected to one of the connecting lines 42 through a feed line 26 to a tap point 25 which connects to conductive element 20. Referring now to FIG. 5, on the second side 34 of the board 24 is a second capacitive element 44. Elements 44 and 48 on each side of board 24 form a parallel plate capacitor whose function is the same as capacitor 46 in FIG. 1. As shown in FIGS. 4 and 5, and as mentioned above, the feed line 26 supported by the board 24 is electrically connected to the conductive band 20 at the tap point 25 and is electrically connected to the first capacitive element 48 at the other end. The tap point 25 is connected to one of the second set 42 of connecting lines. The feed line 26 has a predetermined shape and position to impedance match the antenna 10 in association the length of conductive element 20 and with first capacitive element 48 which electrically couples to the second capacitive element 44 wherein the first and second capacitive elements, 48 and 44 respectively, have predetermined dimensions for matching out the inductance of the feed line 26 and the reactance of antenna 10.

Although not shown, it may be envisioned that the quadrifilar antenna described above may be mounted to a printed circuit board electronic device by placing the second side 34 of the board 24 flush with the circuit board electronic device between the ground conductor 30 and second capacitive element 44 and electrically connecting the ground conductor 30 and second capacitive element 44 to the printed board electronic device by soldering or any electrical attachment means known in the arts. It should be appreciated that the antenna of the present invention eliminates the need for a conventional type transmission line between the antenna 10 and printed board electronic device.

Figure 6:
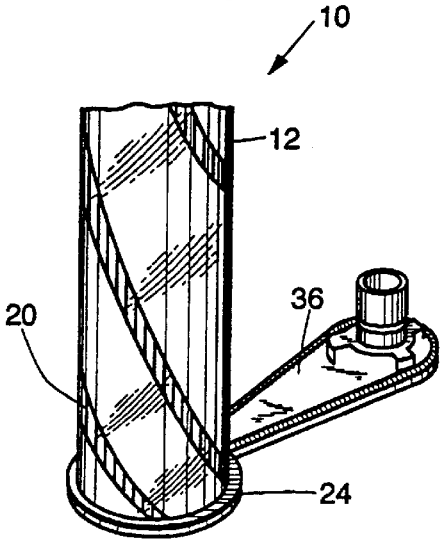
FIG. 6 is a perspective view of another preferred embodiment of the quadrifilar helix antenna in accordance with the present invention.
Figure 7:
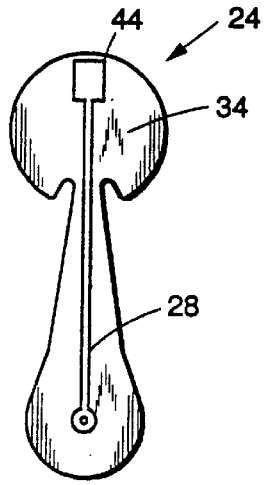
FIG. 7 is a top plan view of one side of a first printed circuit board of the antenna shown in FIG. 6.
Figure 8:
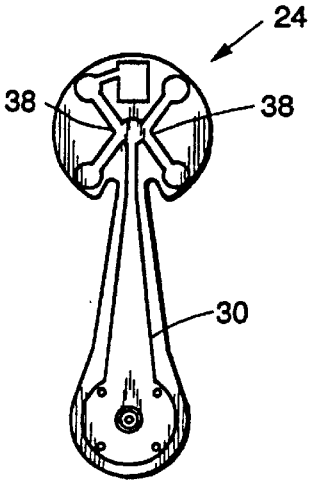
FIG. 8 is a top plan view of a second side of a first printed circuit board of the antenna shown in FIG. 6.

A second preferred embodiment is shown in FIGS. 6 through 8 having the same conductive elements and feed structure described above with the addition of a transmission line 36. The printed circuit board 24 now comprises a microstrip line 28 over an elongated ground conductor 30 formed on the other side of the board 24 wherein the microstrip structure of 28 and 30, respectively, are electrically coupled to each other to form the microstrip transmission line 36 which serves the same purpose as transmission line 36 in FIG. 1. As shown in FIGS. 7 and 8, the microstrip structure 30 of transmission line 36 inwardly tapers to connect to the rectangular portions 38 and microstrip structure 28 connects to second capacitive element 44 on the second side 34 of the board 24, wherein the transmission line 36 is tapered solely for mechanical reasons for bending the flexible printed circuit board 24 away from the conductive elements 14, 16, 18 and 20, respectively, and further does not interfere with the antenna radiation pattern. Typically, in the preferred embodiment the transmission line 36 will have an impedance of 50 ohms allowing the antenna 10 to be fed by a BNC connector or coaxial connector.

Figure 9:
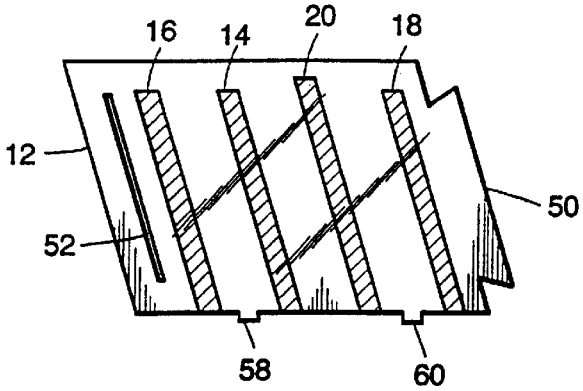
FIG. 9 is a top plan view shown in FIG. 3 displaying a method of manufacturing the antenna.

A method of manufacturing the antenna will now be described with references to FIGS. 9 and 10. Referring to FIG. 9, the substrate 12 having the four conductive elements 14, 16, 18 and 20 has a first extending tab portion 50 at one end and defines a first alignment slot 52 at the opposite end. In production the location of alignment slot 52 is such that the substrate 12 is rolled so that extending tab portion 50 is inserted into alignment slot 52 thereby retaining the substrate 12 into a cylindrical or tubular shape defining the proper radius for mounting the substrate 12 to printed circuit board 24 while simultaneously maximizing the electrical performance of the antenna.

Figure 10:
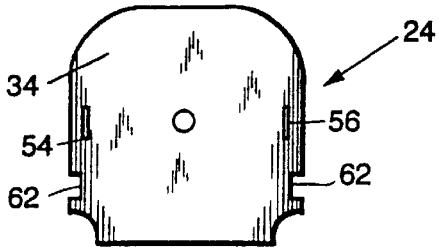
FIG. 10 is a top plan view shown in FIG. 4 displaying a method of manufacturing the antenna.

Referring now to FIG. 10, circuit board 24 defines a second pair of alignment slots 54 and 56 at its sides to receive a second pair of alignment tabs 58 and 60 shown at the bottom of substrate 12 shown in FIG. 9. Second alignment slot 54 is slightly longer then second alignment slot 56 and second alignment tab 58 is slightly longer then second alignment tab 60 so that when substrate 12 is placed upon board 24 and second alignment tabs 58 and 60 are inserted into second alignment slots 54 and 56, the conductive element 20 is located at tap point 25. In this configuration the antenna can now be soldered together. Lastly, referring to FIG. 10, the circuit board 24 additionally defines a pair of alignment indents 62 for use in locating and mounting the antenna against a printed circuit board electronic device.

Figure 11:
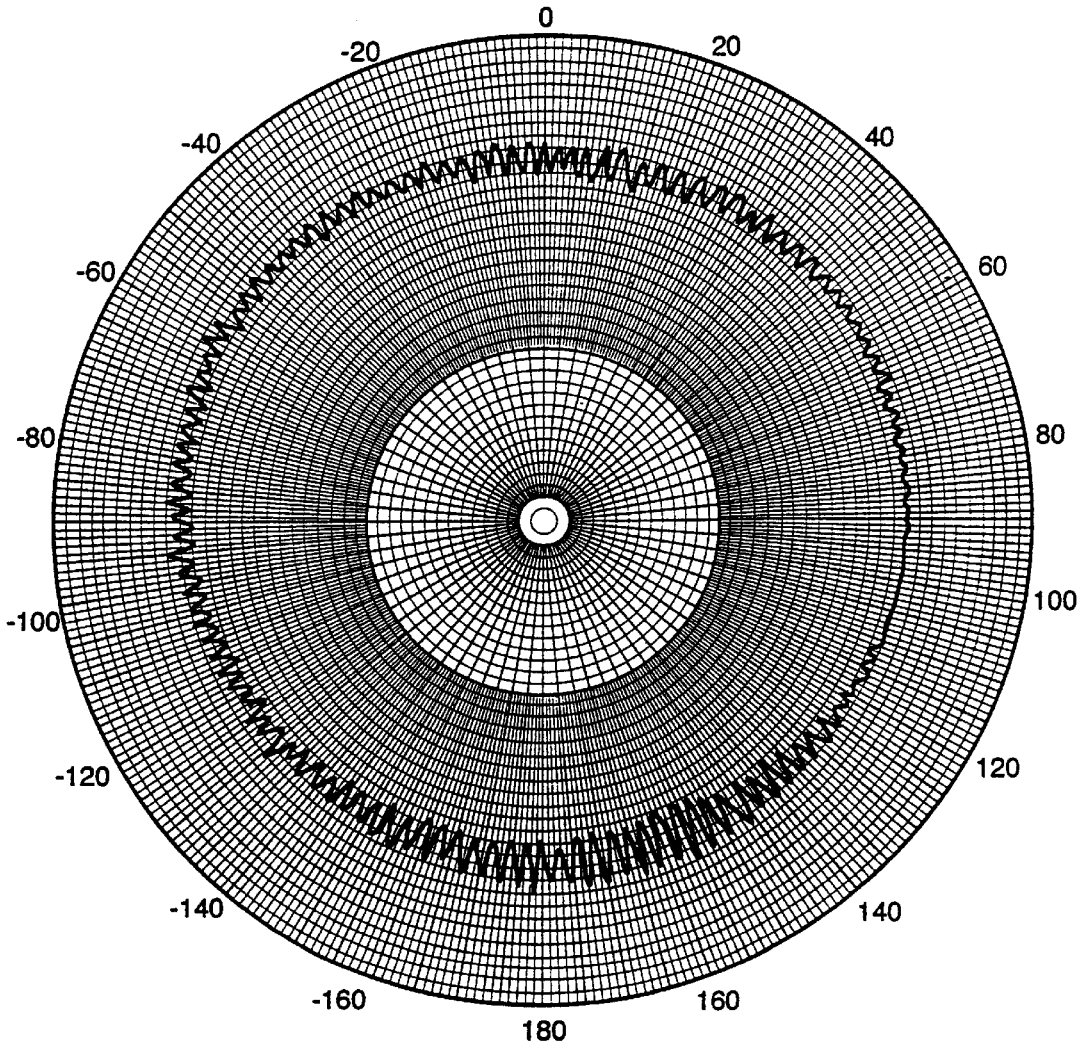
FIGS. 11, 12, 13 respectively represent the radiation pattern and value of VSWR of an antenna built in accordance with the teachings of the present invention.
Figure 12:
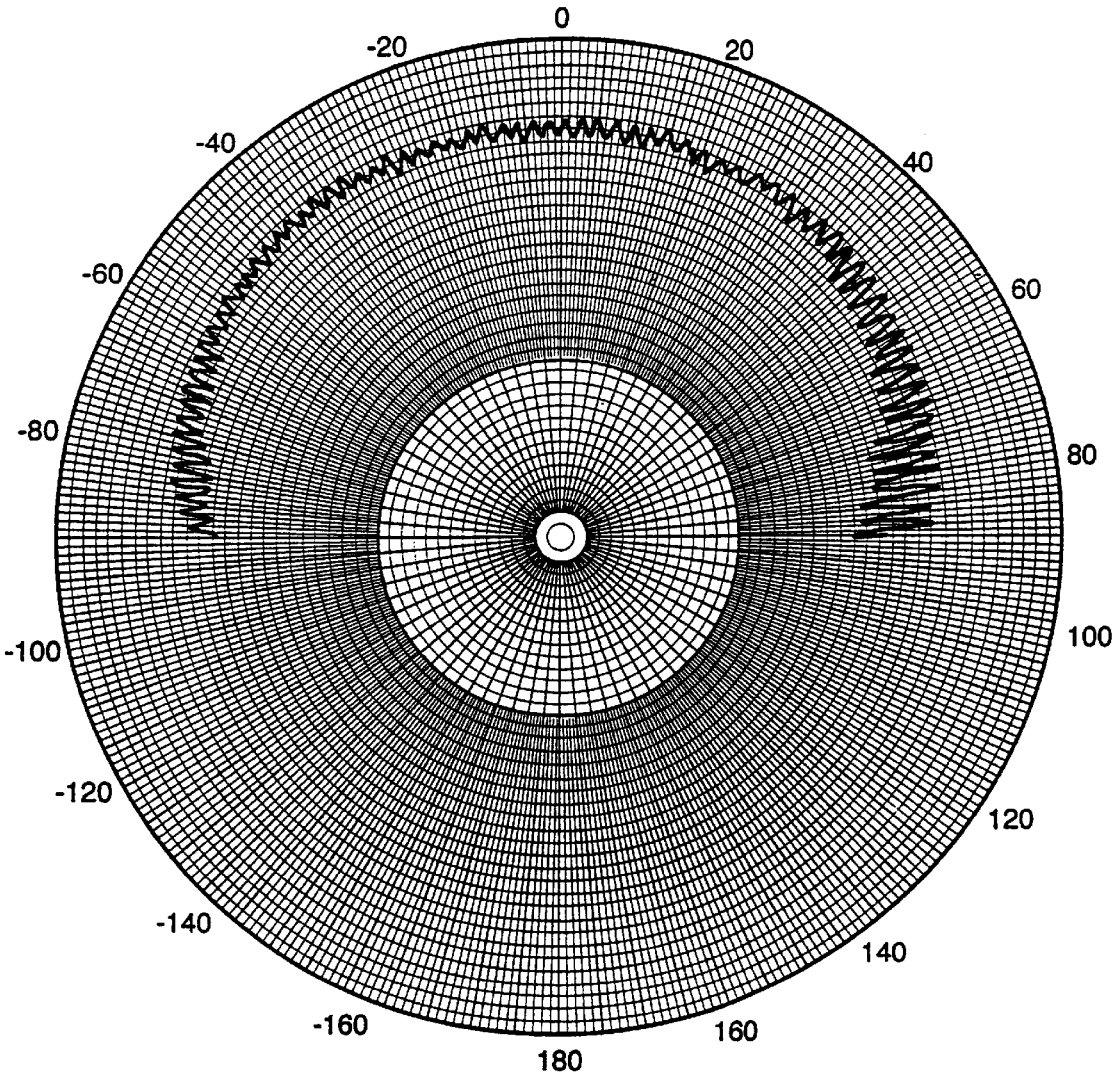
Figure 13:
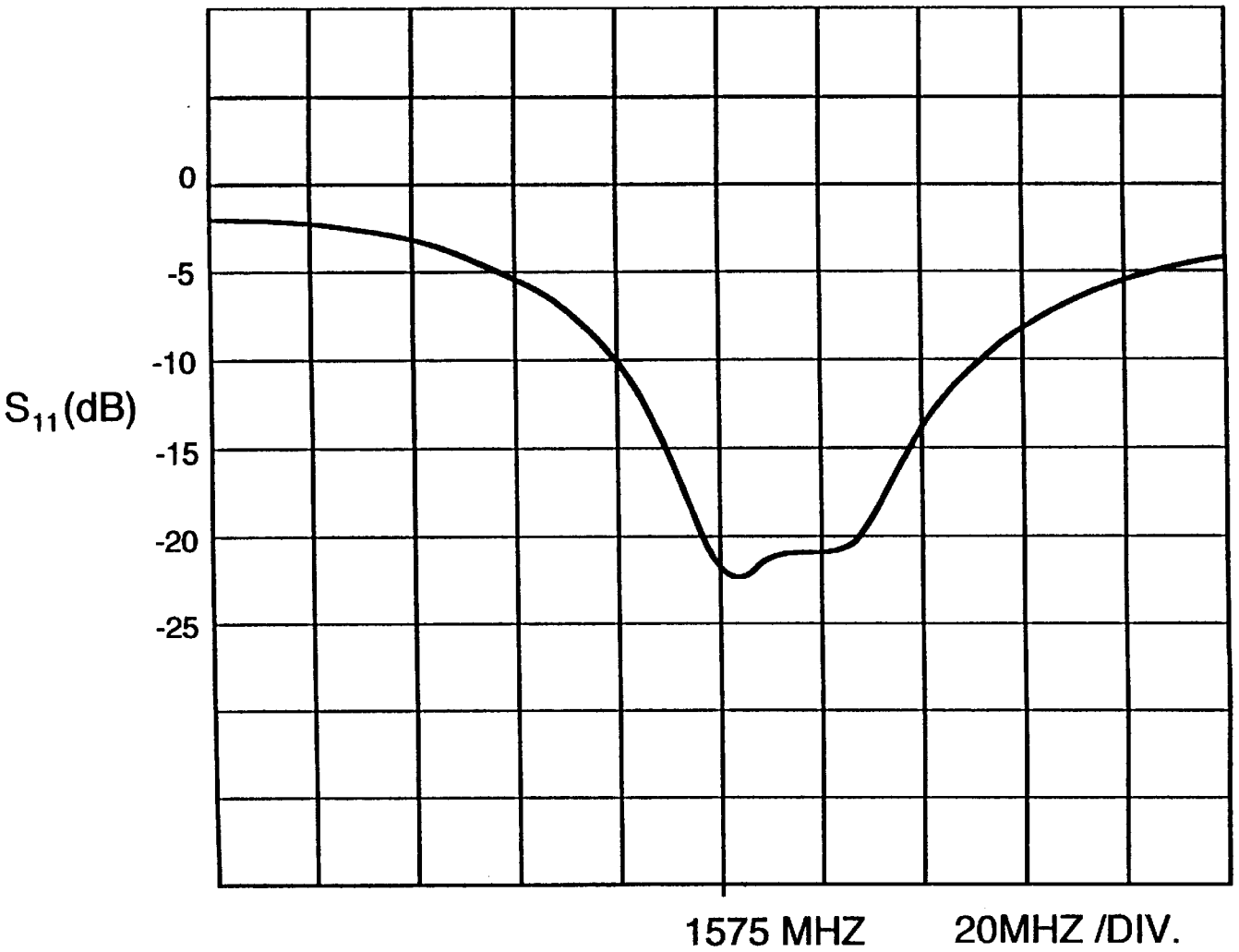

FIG. 11 illustrates the radiation pattern of an antenna built in accordance with the present invention, obtained in the elevational plane at an approximate frequency of 1575 Mhz. A seen by the pattern, the axial ratio is 1.8 db at zenith, and the maximum circular polarized gain is 2.1 dBic. FIG. 12 illustrates the 80 degree off zenith conic pattern of the same antenna, wherein the maximum gain is shown at 130 degrees having an axial ratio of 2.8 dB and a circular polarized gain of 3.3 dBic. Lastly, FIG. 13 illustrates the impedance and return loss for this antenna with a VSWR of 1.15:1. The above data indicates that the antenna of the present invention performs comparably with conventionally designed quadrifilars.

Furthermore, since the antenna is practically matched at 50 ohms around the two resonance frequencies, the feed line in association with the printed circuit technology does not necessitate any specific assembly for additional matching. This frees the antenna from the drawbacks of conventional quadrifilar antenna designs.

There has been described and illustrated herein, an improved quadrifilar antenna formed by printed circuit boards which can be relatively accurately formed and mass produced with predetermined shapes and dimensions, such that relatively little, if any, adjustment is required to obtain an antenna having high reproducibility of electromagnetic characteristics.

While particular embodiments of the invention have been described, it is not intended that the invention be limited exactly thereto, as it is intended that the invention be as broad in scope as the art will permit. The foregoing description and drawings will suggest other embodiments and variations within the scope of the claims to those skilled in the art, all of which are intended to be included in the spirit of the invention as herein set forth.

What is claimed is:

1. An antenna comprising:

a plurality of conductive elements, said plurality of conductive elements defining a plurality of helical pairs along a substrate having a first extending tab at one end and defining a first alignment slot at an opposite end wherein when said substrate is rolled said first extending tab is inserted into said first alignment slot defining a cylinder of constant radius, said helical pairs each having a different electrical length and electrically open at a first end and electrically connected to each other at a second end through a printed circuit board defining a second pair of alignment slots to receive a second pair of alignment tabs defined by said substrate wherein one of said second alignment slots is slightly longer then the other said second alignment slot and one of said second alignment tabs is slightly longer then the other of said second alignment tabs wherein when said substrate is placed upon said board said second alignment tabs are inserted into said second alignment slots for impedance matching said conductive elements; and a feed line electrically connected to at least one of said conductive elements at a tap point and electrically connected to a capacitive element at an opposite end, said feed line having a shape and position to perform impedance matching, wherein said electrical connections and said feed line perform impedance matching, electrical phasing, coupling and power distribution.

2. An antenna according to claim 1, wherein said plurality of conductive elements includes four conductive elements arranged to define a first and second separate helical pairs, said first helical pair differing in electrical length than said second helical pair.

3. An antenna according to claim 2, wherein said printed circuit board having a first and second side, said first side defining a microstrip line and said second side defining a ground conductor, wherein said microstrip line and said ground conductor are electrically coupled to each other to form a ground return path.

4. An antenna according to claim 3, wherein said ground conductor on said second side of said board connects into a midsection of a generally rectangular portion on said first side of said board, said rectangular portion defining a first set and a second set of connecting lines, each said set of said connecting lines being electrically connected to a respective one of said conducting elements wherein said first and said second set of said connecting lines having different electrical lengths thereby producing two different resonant frequencies.

5. An antenna according to claim 4, wherein said first side of said board defining a first capacitive element separated from said rectangular portion and connected to said second set of said connecting lines, and said second side of said board defining a second capacitive element, wherein said first and said second capacitive elements form a parallel plate capacitor.

6. An antenna according to claim 2, wherein one of said conductive elements has a length different from the other said conductive elements.

7. An antenna according to claim 4, wherein said ground conductor on said second side of said board is elongated and inwardly tapers to said rectangular portion for bending an extended printed circuit transmission line away from said conductive elements and preventing interference with antenna radiation patterns.

8. An antenna according to claim 5, wherein said feed line electrically connected to at least one of said conductive elements at said tap point and electrically connected to said first capacitive element at an opposite end, said feed line having a shape and position to impedance match said antenna, wherein said first capacitive element on said first side of said board electrically couples to said second capacitive element on said second side of said board, said first and said second capacitive element having predetermined dimensions for matching out said feed lines inductance and antenna reactance.

* * * * *